United States Patent [19]

Upton

[11] 4,146,092

[45] Mar. 27, 1979

[54] WELL PACKER VALVE SEAL ASSEMBLY

[75] Inventor: Thomas E. Upton, Garland, Tex.

[73] Assignee: Dresser Industries, Inc., Dallas, Tex.

[21] Appl. No.: 913,411

[22] Filed: Jun. 7, 1978

[51] Int. Cl.[2] ..... E21B 33/12

[52] U.S. Cl. ..... 166/120; 166/183; 251/361

[58] Field of Search ..... 166/120, 129, 152, 183; 251/361, 364

[56] References Cited

U.S. PATENT DOCUMENTS

| | | | |
|---|---|---|---|
| 2,418,493 | 4/1947 | Allen | 166/183 |
| 2,673,062 | 3/1954 | Cornelius | 251/361 |
| 3,743,016 | 7/1973 | Crow | 166/120 |

*Primary Examiner*—James A. Leppink
*Attorney, Agent, or Firm*—Richard M. Byron

[57] ABSTRACT

A seal assembly for a valve in a mechanical setting retrievable and pressure balanced packer has a valve seal mounted on a bushing mounted around a mandrel joined to an anchor and enclosed within a balance chamber housing. The valve seal is retained between the bushing and an overlapping coaxial face seal retainer such that only a relatively small portion of the face seal ring will contact the seal surface of a valve seat on the packer.

8 Claims, 4 Drawing Figures

WELL PACKER VALVE SEAL ASSEMBLY

TECHNICAL FIELD

This invention is related to valve seals for downhole oil well tools. More specifically the invention is related to a valve seal assembly for a well packer which is mechanically settable yet incorporates a valve to control fluid flow through the packer to a hydraulically actuated slip on another portion of the packer.

BACKGROUND OF THE INVENTION

In regard to the prior art, all packers which are provided with an internal passageway to transmit a well fluid from below the seal of the packer to above the seal of the packer for operating a hydraulically actuated slip incorporate a valve around some portion of a mandrel. Normally this valve is comprised of a metal valve seat which is mounted on one portion of the packer and engages a nonmetallic valve seal on another portion of the packer when the packer is set. This valve functions to provide a discontinuity in the fluid path from the well fluid below the packer seal to the hydraulically actuated slip so that it cannot be actuated or energized until the valve is closed. When this valve is initially closed upon setting of the packer, it is subjected to a significant pressure differential and a small fluid flow between the fluid passageway and the well fluid around the packer. However, when releasing the packer, the valve is usually subjected to both a substantially large pressure differential and fluid flow. In this instance, the well fluid pressure below the packer is present in the internal passageway and this is usually substantially different from pressure present around the exterior of the packer above the packer seal. When the packer is released, the valve opens thereby subjecting the valve seal to a substantially large fluid flow. This large fluid flow is damaging to the seal because of fluid errosion effects on the seal surface. Also it is typical in prior art seal constructions for the seal ring to be a simple generally cross-sectionally rectangular ring of material bonded into a groove in the tool structure. This prior art construction is not satisfactory because the seal rings tend to be blown out of the valve by the typically large pressure differential and fluid flow placed across them as the packer valve opens. Failure of these bonded in place valve seal rings can be attributed to any number of factors; for example, a poor bonding technique which results in a weak bond or a simple failure of the bond which will allow fluid to get between the seal ring material and in the groove thereby weakening the structure and allowing the seal ring to blowout. Another possible cause of failure of this type of seal construction is the entrainment of fluids underneath or along the sides of the seal ring either within the seal ring material or in any bonding agent which might be used.

SUMMARY OF THE INVENTION

In an embodiment, a packer valve seal assembly includes a face seal bushing which is loosely mounted around the mandrel of a packer and a face seal retainer that is threadedly secured to the lower end portion of the face seal bushing with a groove or seal pocket formed in a lower end of the juncture of the seal retainer and the seal bushing to cooperatively house and retain a seal ring. The seal pocket is shaped to confine the seal ring in a fashion which will not permit it to be blown out of its supporting structure when the packer valve is opened even under tremendously large pressure differential and fluid flow. The face seal bushing and the face seal retainer are sealed around their outer perimeter with a balance chamber housing which is mounted on an anchor body of the packer and extends over the seal assembly.

One object of this invention is to provide a valve seal assembly for a well packer which overcomes the aforementioned disadvantages of the prior art seal constructions.

Still one other object of this invention is to provide a valve seal construction for a downhole oil well tool having a valve that is normally opened under a large differential pressure wherein the valve seal is constructed such that is will not be blown out of its seat pocket when the valve is opened under this large differential pressure and a large fluid flow.

Still another object of this invention is to provide a well packer valve seal assembly which has a face seal bushing mounted around the packer mandrel and a face seal retainer mounted around the bushing with a seal ring pocket defined by the bushing and the retainer and shaped such that the seal ring is compressibly retained within the seal pocket, prevented from blowing out when the packer is released with a large differential pressure across the valve, and constructed such that the seal ring can be easily replaced should it ever fail.

Various other objects, advantages, and features of this invention will become apparent to those skilled in the art from the following discussion, taken in conjunction with the accompanying drawing, in which:

Figure 1:
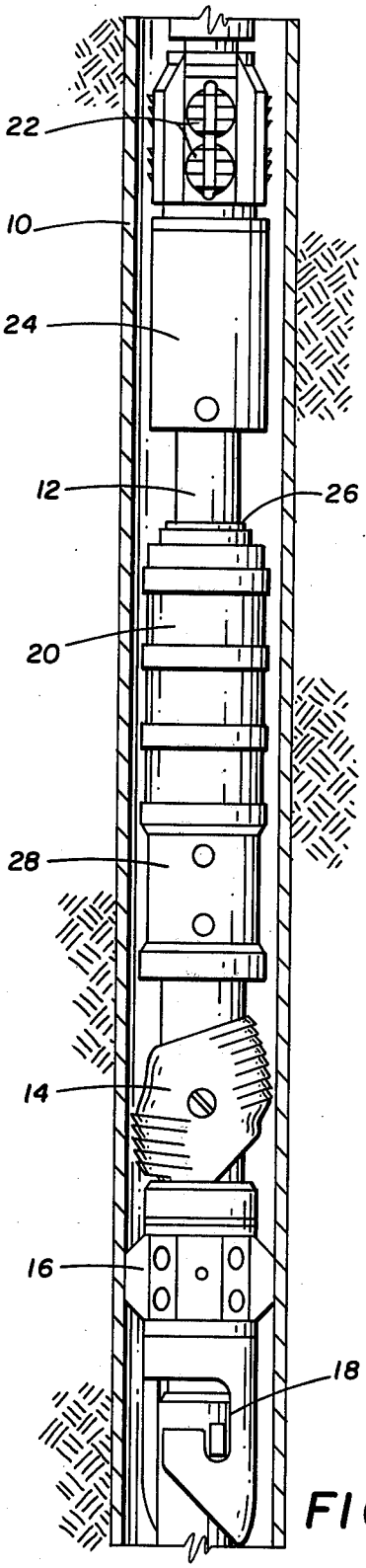
FIG. 1 is an elevation view of a mechanical single string retrievable packer positioned inside a well casing with the packer in the run-in position.

The following is a discussion and description of preferred specific embodiments of the valve seal assembly of this invention, such being made with reference to the drawing, whereupon the same reference numerals are used to indicate the same or similar parts and/or structure. It is to be understood that such discussion and description is not to unduly limit the scope of the invention.

DETAILED DESCRIPTION

FIG. 1 shows a mechanical single string retrievable packer which is equipped with the valve assembly of this invention. The packer has a mandrel 12 running the length thereof with a lower slip 14, friction pad 16, and a J-slot setting control 18 on the lower portion thereof. A plurality of expandable packer elements or rubbers 20 are mounted around the mid portion of the packer. On the upper portion of the packer a hydraulically actuated piston slip 22 is located above a balancing chamber housing 24 which encloses the valve seal assembly of this invention. A valve seat 26 is mounted above packer rubbers 20. When the packer is in the run-in position as shown in FIG. 1, it is separated from the valve seal assembly. The packer is provided with an internal passageway having an inlet at a port through spacer collar 28. The passageway extends underneath rubbers 20 past the valve seat and the valve seal assembly to the hydraulically actuated pistion slip 22. This fluid passageway provides open fluid communication from a well fluid chamber below packer rubbers 20 to the actuating mechanism of piston slip 22 when the packer is set so that fluid pressure from the well fluid chamber can actuate the piston slip because of the pressure differential across the packer.

Figure 2:
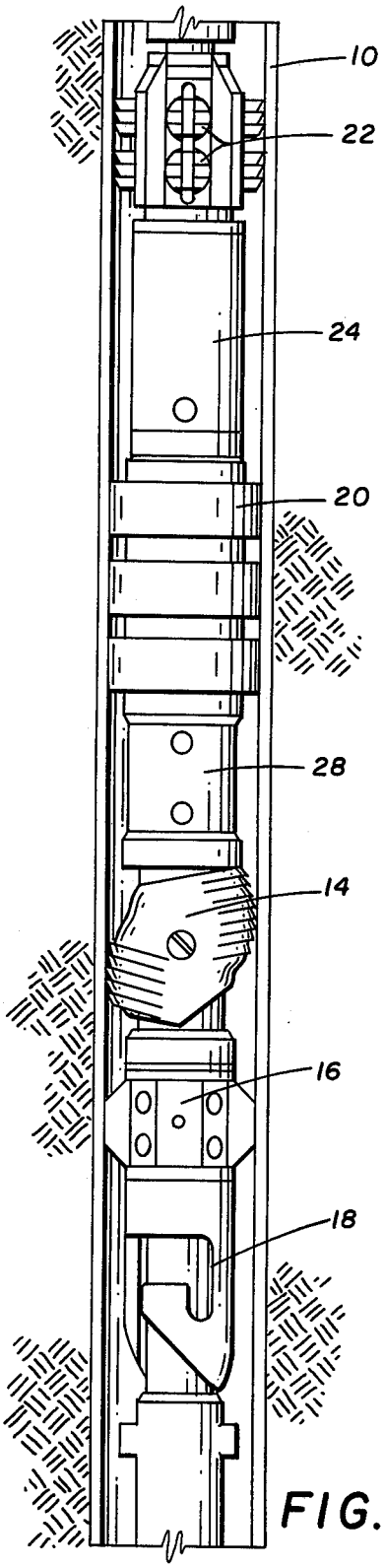
FIG. 2 is an elevation view of the packer and the casing shown in FIG. 1 with the packer in the set position.

As the packer is being run into the well, the valve is opened and it closes when the packer is set as shown in FIG. 2. In setting the packer, J-slot setting control 18 is actuated by raising the tubing that supports the packer and turning the tubing relative to the casing then lowering the tubing which engages lower slip 14 and expands packer rubbers 20. As this is done, valve chamber housing 24 is lowered into position over valve seat 26 which closes the valve thereby completing continuity of the fluid passageway from below the packing rubbers or elements 20 to piston slips 22.

Figure 3:
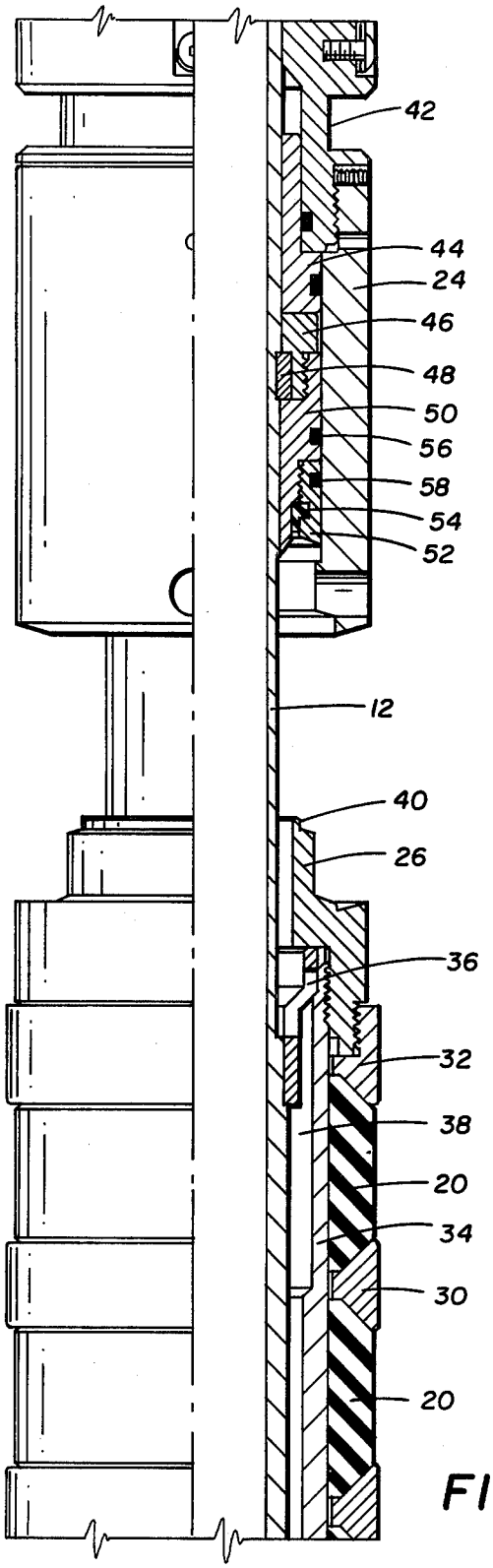
FIG. 3 is an elevation view of a fragment of the packer shown in FIGS. 1 and 2 with a quarter of the packer cutaway for clarity exposing the valve seal construction, the valve seat and associated portions of the packer structure.
Figure 4:
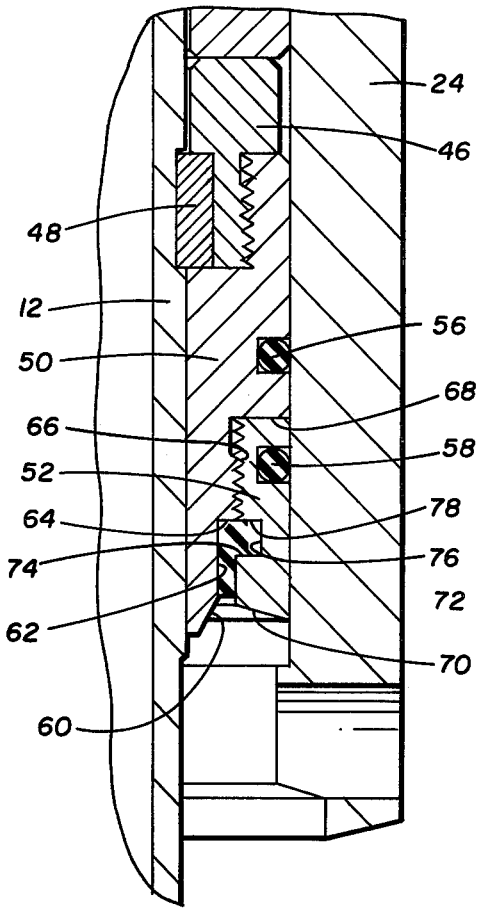
FIG. 4 is an enlarged fragmentary cross-sectional view of the valve seal assembly removed from FIG. 3.

Referring now to FIG. 3, such shows in enlarged detail some portions of the packer structure and the valve seal assembly of this invention. In the lower portion of FIG. 3 the plurality of rubbers or packing elements are positioned in an end-to-end relation and separated by spacers 30 with a thimble 32 at the top of the upper most rubber. The interior of rubbers 20 rest against the exterior of a shell 34. Shell 34 is spaced from mandrel 20 at the upper end thereof by a perforated spacer washer 36 thereby forming the packer internal fluid passageway 38 between the interior of the shell 34 and the exterior of mandrel 12. Valve seat 26 is an annular member which is formed on the upper end of a collar that is threadedly secured on the upper end of shell 34. A valve seat lip 40 extends from valve seat 26 at the upper end of the valve seat in a coaxial relation to mandrel 12.

In the upper portion of FIG. 3, piston slips 22 are mounted in an anchor body 42. Valve chamber housing 24 is mounted on the lower end of anchor body 42. Balance chamber housing 24 encloses a balance piston 44, a retainer 46 below balance piston 44, a keeper 48 below and radially inward of retainer 46, a face seal bushing 50 below and secured to keeper 48 and a valve face seal retainer 52 secured to face seal bushing 50 at the open or lower end of balance chamber housing 24. Balance piston 44 functions as a pressure balancing device within the internal passageway of the packer to transfer a fluid pressure differential force downward on mandrel 12 through retainer 46 and keeper 48. The function of balance piston 44 is to keep a downward force on mandrel 12 at all times after the packer is set in order to prevent it unsetting itself due to an unbalanced pressure condition. A seal ring 54 is mounted in a seal pocket formed between face seal bushing 50 and face seal retainer 52. An O-ring 56 is mounted around the outer perimeter of face seal bushing 50 and sealingly engaged with the interior of balanced chamber housing 24. Similarly another O-ring 58 is mounted around the outer periphery of face seal retainer 52 and sealingly engaged with the interior of balanced chamber housing 24. O-rings 56 and 58 prevent fluid from entering the joint between face seal bushing 50 and face seal retainer 52.

Face seal bushing 50 is loosely mounted on mandrel 12 with the inner surface thereof sized such that fluid can flow between the exterior of mandrel 12 and the interior of the bushing. Face seal bushing 50 has a radially inwardly tapering lip 60 on the lower end portion thereof which forms the inner portion of a valve seat guide. Immediately above and adjacent to this tapered lip 60 is a generally cylindrical surface 62 which forms the inside resting surface for seal ring 54. This cylindrical surface terminates at a radially outwardly extending abutment 64 which forms a surface generally transverse to mandrel 12 that defines a portion of the seal pocket bottom or closed end. The outer periphery of this abutment terminates at a threaded surface 66 which is utilized to threadedly mount face seal retainer 52. Another radially outwardly extending abutment is formed in the mid portion of face seal bushing 50 at what is the upper end of the threaded surface to form a stop or shoulder 68 which is abutted by the upper end of face seal retainer 52.

Face seal retainer 52 is a generally cylindrically shaped element with a radially outwardly tapering lip or inclined surface 70 on what is the lower end thereof forming the outer portion of a valve seat guide for valve seat 26. The interior of face seal retainer 52 has an uniformed diameter interior surface 72 in the lower end thereof which connects with a radially enlarged recess defining the radially outer portion of the seal pocket. This recess portion of face seal retainer 52 is generally cross-sectionally rectangular with a lower side surface 74 extending radially outward from the upper end of surface 72, an uniform diameter outer side 76 extending upward to an upper side surface 78 aligning with radially outwardly disposed abutment 64 of face seal bushing 50. Face seal retainer 52 is threaded on the upper end of its interior for attachment to threads 66 on face seal bushing 50. Face seal retainer 52 is provided with a radially outwardly disposed abutment on the uppermost end thereof for flush contact with the matching abutment of face seal bushing 50.

Seal ring 54 is generally cross-sectionally L-shaped with the elongated portion thereof generally aligned with mandrel 12 and the shorter portion thereof disposed radially outward relative to mandrel 12 and located within the recess of face seal retainer 52. The radial thickness of the shorter portion of face seal 54 is substantially thicker than the radial thickness of the elongated portion thereof. Seal ring 54 in its free and unmounted condition is constructed with a larger radial thickness than the physical dimension between surface 62 and surfaces 72 and 76 of the seal pocket in which it is mounted. Also, the portion of seal ring 54 which is positioned within the recess of face seal retainer 52 between surfaces 74 and 78 is constructed of a larger physical dimension than the dimension between these surfaces. Because seal ring 54 is constructed with a larger cross-sectional dimension than the physical dimensions of the seal pocket, it is compressibly retained within the seal pocket when it is installed in the packer. Compressibly retaining seal ring 54 assures that it is retained within the seal pocket even when it is influenced by larger pressure differential forces across the exposed face of the seal ring as the valve is opened and a large fluid flow is created when the packer is released. The exposed portion of seal ring 54 is the annular segment thereof which lies transverse to mandrel 12 between the facing sides 62 and 72 of face seal bushing 50 and face seal retainer 52.

Because seal ring 54 is not bonded in place and the pieces of structure which make up the seal pocket are threadedly joined together, this makes the seal ring easily removable from the packer for replacement. Removal of seal ring is accomplished by removing valve housing 24 from anchor body 42 at their threaded connection then separating face seal bushing 50 and face seal retainer at their threaded connection. Once this has been done, the old seal ring can be removed from seal retainer 52 and replaced with a new one, then these parts are replaced on the packer. This feature of the seal assembly is very important for operation of the packer in field conditions because if the valve begins to leak, the seal ring can be easily and rapidly replaced without returning the packer to a maintenance facility for repair. When the seal began leaking or was blown out in the prior art devices, they had to be returned to a maintenance facility for replacement of the components which were bonded to the seal ring which is inconvenient, time consuming and expensive.

The embodiments of the invention in which an exclusive property or privilege is claimed are defined as follows:

1. In a mechanical setting and pressure balanced retrievable well packer having a lower slip assembly mechanically settable, an expandable packer seal assembly in a mid portion thereof, an upper hydraulic pressure actuated slip assembly, a fluid passageway around a mandrel within the packer from an inlet below the expandable packer seal assembly to the hydraulic pressure actuated slip assembly, and a valve located in a balance chamber housing and in the fluid passageway between the hydraulic pressure actuated slip and the inlet thereof, an improvement in said valve, comprising:

(a) a seal bushing loosely mounted around said mandrel to permit fluid passage between said mandrel and said bushing, said bushing having a cylindrically shaped seal support surface on one end thereof, a radially outwardly extending abutment at an upper end of said seal support surface, and a radially inwardly tapering lip at a lower end of said seal support surface forming a portion of a valve seat guide;

(b) a face seal retainer ring rigidly secured to said seal bushing and having an inner side extending over said cylindrically shaped seal support portion and said inwardly tapering portions thereof in spaced relation thereto and having a radially outwardly extending recess in a mid portion of the interior thereof and a radially outwardly tapering lip on a lower portion thereof forming a portion of a valve seat guide;

(c) said bushing and said face seal retainer cooperatively forming a seal pocket between said seal support surface, said radially outwardly extending abutment, said recess and said inner side; and (d) a seal ring retained between said bushing and said seal retainer and including an enlarged portion positioned within said recess and an elongated portion extending into the space between said seal bushing and said face seal retainer.

2. The improvement of claim 1, wherein:

(a) said face seal retainer is threadedly mounted on said seal bushing; and (b) said face seal retainer and said seal bushing each have a seal ring mounted around the outer periphery thereof in fluid tight sealing contact with the interior of said balance chamber housing.

3. The improvement of claim 1, wherein said recess is cross-sectionally rectangularly shaped with one side thereof aligning with said seal bushing rigidly outwardly extending abutment.

4. The improvement of claim 1, wherein said seal ring is substantially cross-sectionally larger than said seal pocket such that said seal ring is compressibly retained within said seal pocket.

5. A downhole well tool valve seal assembly, comprising:

(a) a bushing slidably mounted around a mandrel such that fluid can flow around said mandrel within the interior of said bushing when the well tool is in one operating position;

(b) a face seal retainer rigidly and removably mounted on one end of said bushing;

(c) a seal pocket formed between said bushing and said seal retainer and open at one end of said bushing and said face seal retainer, said seal pocket being cross-sectionally generally L-shaped with an elongated longitudinally disposed portion thereof extending along said mandrel from said open end and a shorter portion extending radially outward relative to said mandrel at the end of said elongated portion opposite to said open end;

(d) a cross-sectionally L-shaped seal ring substantially larger in cross-section than said seal pocket and compressibly mounted within said seal pocket to receive a valve seat in sealing contact on an exposed end portion thereof which is located at said open end of said seal pocket when said well tool is in a second operating position with the well tool valve closed; and (e) a housing mounted with said well tool and extending over the radially outer periphery of said bushing and said seal retainer to enclose them within said well tool.

6. The valve seal assembly of claim 5, wherein:

(a) said seal retainer is threadedly mounted with said seal bushing; and (b) said bushing and said seal retainer each have seal elements around the outer pheriphery thereof to sealingly engage the interior of said housing.

7. The valve seal assembly of claim 5, wherein said seal pocket shorter portion is at least as long in the direction longitudinally aligned with said mandrel as the radial thickness of said elongated portion thereof, and said shorter portion is substantially radially larger than the radial thickness of said elongated portion thereof.

8. The valve seal assembly of claim 5, wherein said seal element is substantially longitudinally shorter than said seal pocket elongated longitudinal portion such that said valve seal assembly will receive a lip of a valve seat when said well tool is in said second operating position.

* * * * *